US005873132A

United States Patent [19]

Grilliot et al.

[11] Patent Number: 5,873,132

[45] Date of Patent: Feb. 23, 1999

[54] PROTECTIVE GARMENT WITH ATTACHABLE HOOD

[76] Inventors: William L. Grilliot; Mary I. Grilliot, both of P.O. Box 14616, Dayton, Ohio 45413

[21] Appl. No.: 17,298

[22] Filed: Feb. 2, 1998

[51] Int. Cl.[6] ..... A41D 13/00; A42B 1/04; A62B 17/00; A62B 17/04

[52] U.S. Cl. ..... 2/84; 2/85; 2/93; 2/202; 2/203; 2/205; 2/410

[58] Field of Search ..... 2/4, 84, 85, 88, 2/93, 94, 97, 129, 172, 173, 202, 203, 205, 410; 24/573.1, 573.5, 573.7

[56] References Cited

U.S. PATENT DOCUMENTS

| | | | |
|---|---|---|---|
| 1,485,392 | 3/1924 | Halek | 2/84 |
| 2,086,325 | 7/1937 | Frankel | 2/84 |
| 2,170,339 | 8/1939 | Reeves | 2/84 |
| 4,507,806 | 4/1985 | Coombs | 2/85 |
| 4,768,233 | 9/1988 | Grilliot | 2/81 |
| 5,005,216 | 4/1991 | Blackburn et al. | 2/84 |
| 5,274,850 | 1/1994 | Aldridge | 2/84 |

*Primary Examiner*—William Stryjewski
*Assistant Examiner*—Gary L. Welch
*Attorney, Agent, or Firm*—Rockey, Milnamow & Katz, Ltd.

[57] ABSTRACT

In a protective garment, such as one worn by a firefighter, a rescue worker, or a racing car driver, in which fasteners, such as snap fasteners, are used for attaching a liner detachably to a coat, a hood having a cape hanging downwardly is provided with loops. Each loop has two ends and is affixed at each end to the cape. Each loop is adapted to extend around a respective fastener, between the coat and the liner, so as to attach the hood detachably when the liner is attached detachably to the coat. In one contemplated embodiment, the ends of each loop are affixed to each other and to the cape. In another contemplated embodiment, the loops are defined by a continuous ribbon affixed to the cape at spaced intervals defining the ends of the loops.

16 Claims, 4 Drawing Sheets

FIG. 2
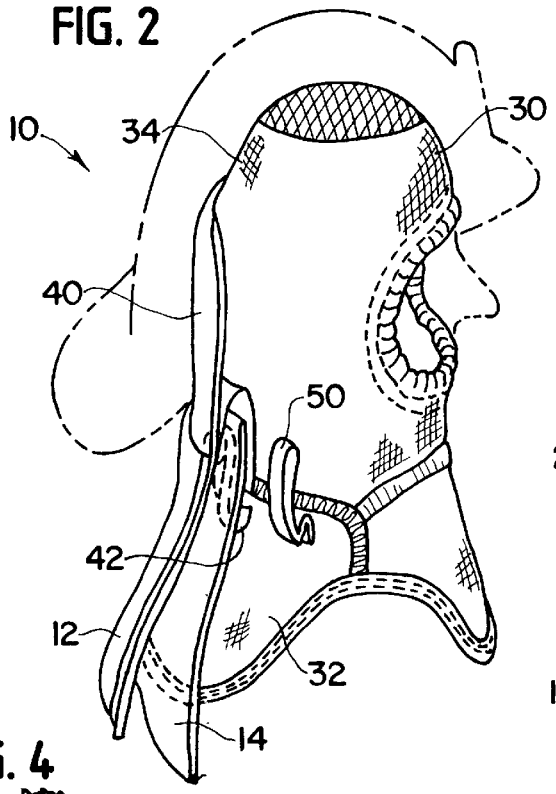
FIG. 3
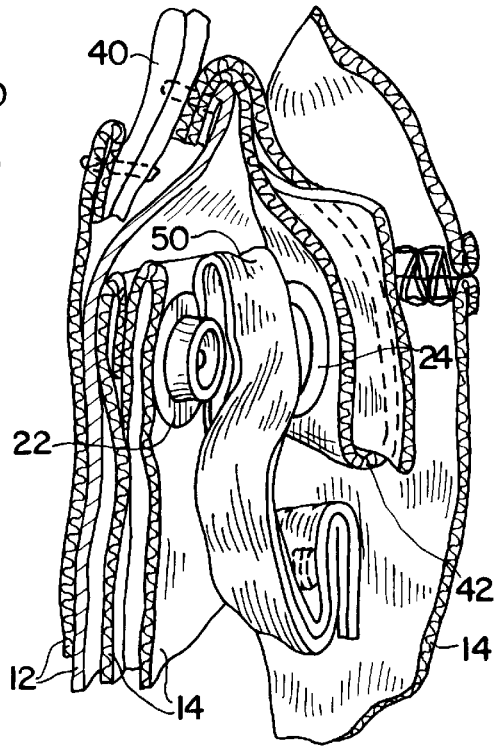
FIG. 4
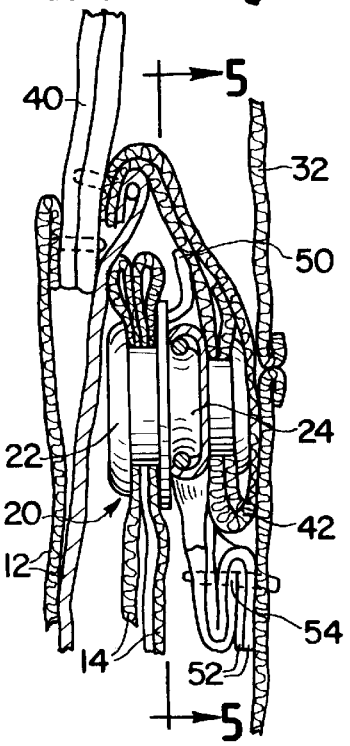
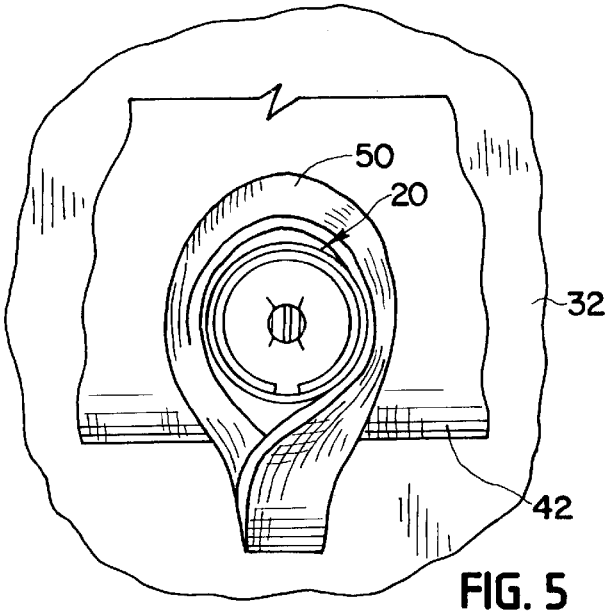
FIG. 5

FIG. 7
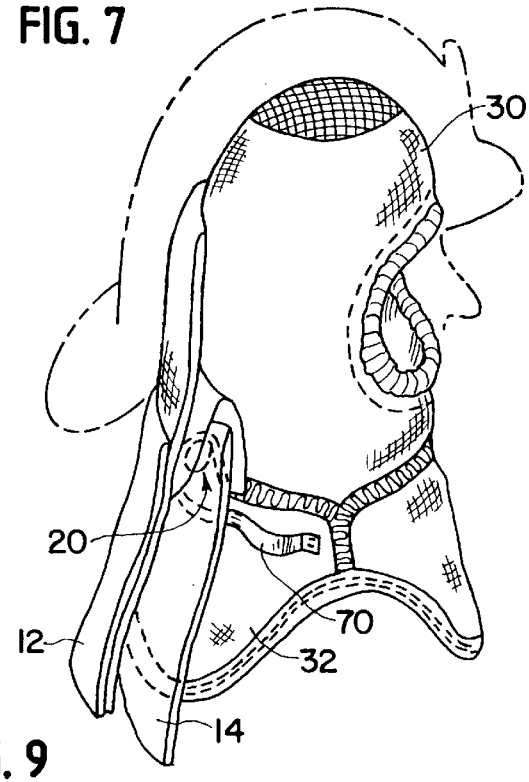
FIG. 8
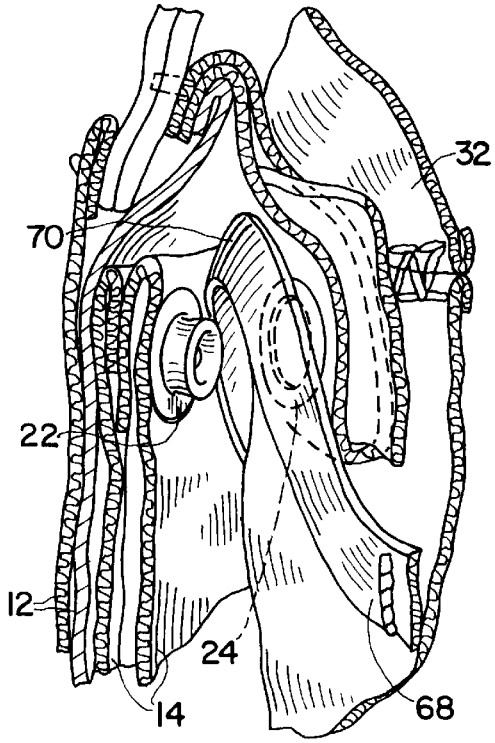
FIG. 9
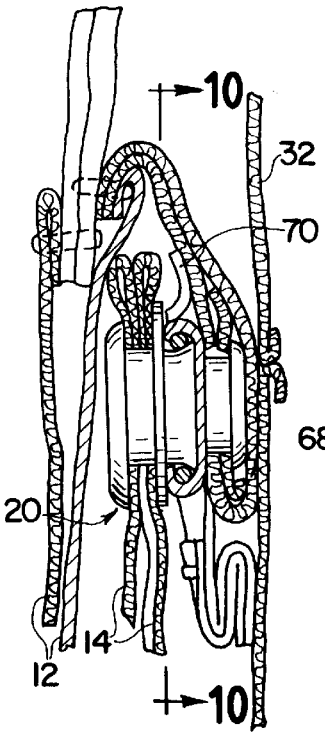
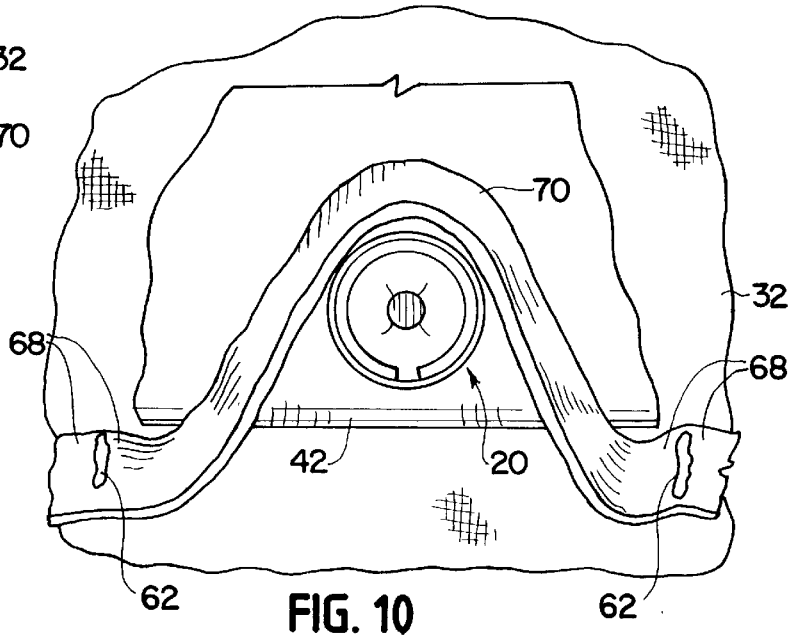
FIG. 10

PROTECTIVE GARMENT WITH ATTACHABLE HOOD

TECHNICAL FIELD OF THE INVENTION

This invention pertains to a protective garment, such one worn by a firefighter, by a rescue worker, or by a racing car driver, which comprises a coat, a liner, and fasteners, such as snap fasteners, for attaching the liner detachably to the coat, at spaced intervals, and which is worn with a protective hood having a cape hanging downwardly. This invention provides the cape of the hood with loops, each being adapted to extend around a respective fastener, between the coat and the liner.

BACKGROUND OF THE INVENTION

Commonly, a protective garment worn by a firefighter, a rescue worker, or a racing car driver comprises a coat, which may have a collar and which may have plural layers, a liner, which may have plural layers and which may be thermally insulated, and fastener means, such as snap fasteners, which are used for attaching the liner detachably to the coat, at spaced intervals. Commonly, such a garment is worn with a hood having a cape, which hangs downwardly so as to cover the firefighter's shoulders. Usually, if snap fasteners are used, each fastener has a male portion and a female portion with one such portion affixed to the coat and with the other portion affixed to the liner.

Although it was more common for the hood having the cape to be separately worn, not attached to the coat or to the liner, it was also common to attach the hood by unsnapping several such snap fasteners, draping the cape between the male and female portions of the unsnapped fasteners, and resnapping the unsnapped fasteners. It was known for the resnapped fasteners thus to tear holes in the cape.

Currently, such a practice of unsnapping several such snap fasteners, draping the cape between the male and female portions of the unsnapped fasteners, and resnapping the unsnapped fasteners is disapproved. Such a practice is unworkable with hoods having capes that are double-layered or very thick, whereby to conform to current standards promulgated by the National Fire Protection Association, as those hoods tend to be too thick to be so attached. Moreover, as those standards prohibit placing holes, such as button holes, in hoods, any holes torn by snap fasteners in the cape of a hood would cause the hood to become nonconforming.

U.S. Pat. No. 5,274,850 to Donald Aldridge discloses another known way to attach a hood detachably to the collar of a coat. Hook-and-loop fasteners are disclosed for fastening the hood to the collar.

SUMMARY OF THE INVENTION

This invention improves a protective garment, such as one worn by a firefighter, a rescue worker, or a racing car driver, which comprises a coat, a liner, and fasteners adapted to attach the liner detachably to the coat, and which is worn with a protective hood having a cape hanging downwardly. This invention improves the protective garment by providing the protective hood with loops. Having two ends and being affixed at each end to the cape, each loop is adapted to extend around a respective fastener, between the coat and the liner, so as to attach the hood detachably at similar intervals when the liner is attached detachably to the coat by the fasteners. Herein, it is convenient to refer to the garment as comprising the hood, as well as the coat and other components noted above.

In one contemplated embodiment, the ends of each loop are affixed to each other and to the cape of the hood. In another contemplated embodiment, the ends of each loop are spaced from each other where affixed to the cape of the hood. Preferably, in the latter embodiment, the loops are defined by a continuous ribbon affixed to the cape at spaced intervals defining the ends of the loops.

Preferably, in each contemplated embodiment, each fastener is a snap fastener having a male portion and a female portion with one said portion affixed to the coat and with the other portion affixed to the liner.

These and other objects, features, and advantages of this invention are evident from the following description of two contemplated embodiments of this invention, with reference to the accompanying drawings.

BRIEF DESCRIPTION OF THE DRAWINGS

FIG. 2 is a fragmentary, partly broken away, perspective view of the firefighter's garment of FIG. 1, as taken from another vantage and as shown being worn by a firefighter who and whose helmet are shown in broken lines.

FIGS. 3 and 4, on a larger scale, are fragmentary details showing one loop of a hood coacting with a snap fastener used to attach a liner detachably to a coat, in the embodiment of FIGS. 1 and 2. The snap fastener is open in FIG. 3 and is closed in FIG. 4.

FIG. 5 is a fragmentary, sectional view taken along line 5—5 in FIG. 4, in a direction indicated by arrows.

FIG. 7 is a fragmentary, partly broken away, perspective view of the firefighter's garment of FIG. 6, as taken from another vantage and as shown being worn by a firefighter who and whose helmet are shown in broken lines.

FIGS. 8 and 9, on a larger scale, are fragmentary details showing one loop of a hood coacting with a snap fastener used to attach a liner detachably to a coat, in the embodiment of FIGS. 6 and 7. The snap fastener is open in FIG. 8 and is closed in FIG. 9.

FIG. 10 is a fragmentary, sectional view taken along line 10—10 in FIG. 9, in a direction indicated by arrows.

DETAILED DESCRIPTION OF ILLUSTRATED EMBODIMENTS

Figure 1:
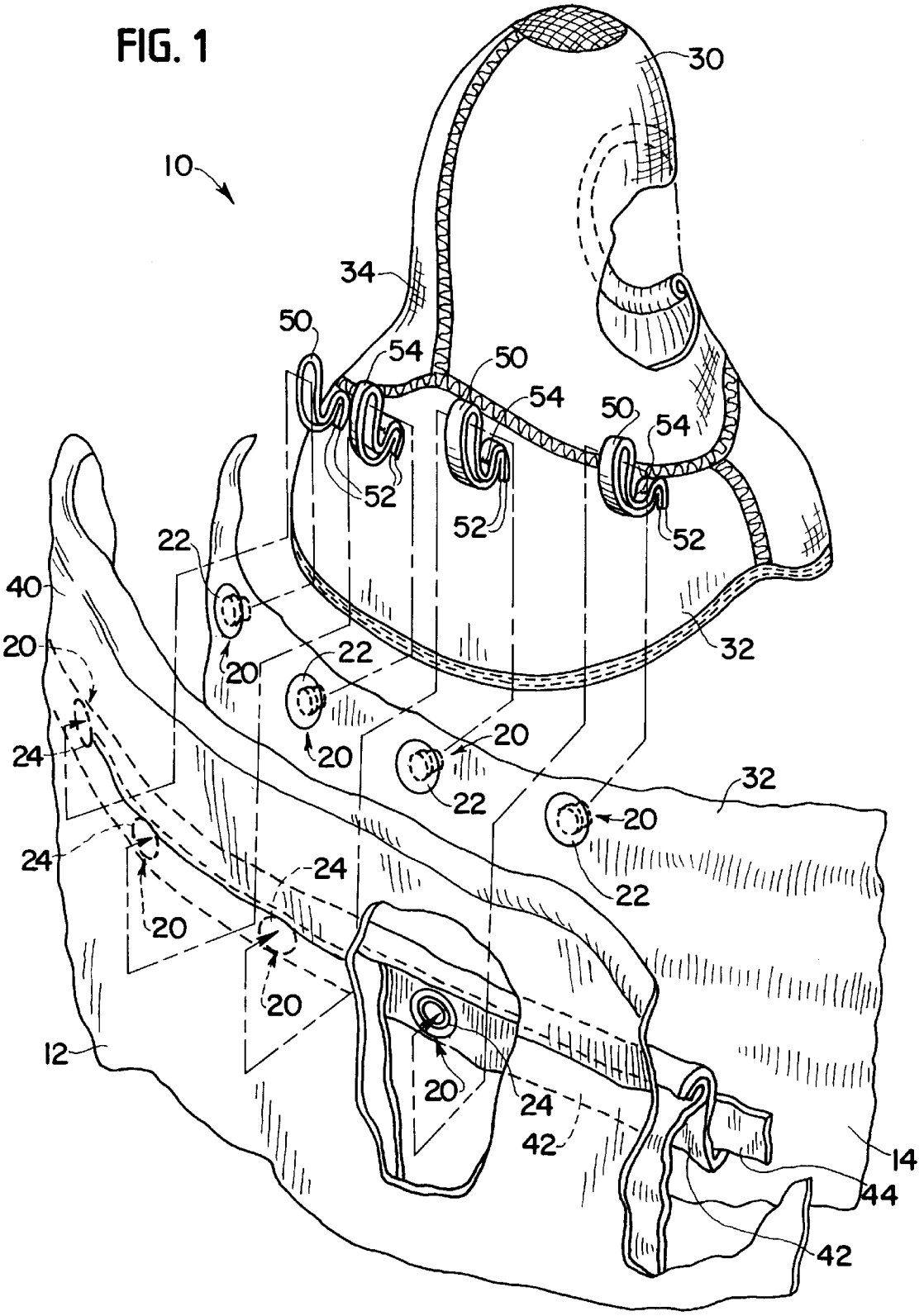
FIG. 1 is a fragmentary, partly broken away, exploded, perspective view of a firefighter's garment constituting one contemplated embodiment of this invention, as taken from one vantage.

As shown in FIGS. 1 and 2, a firefighter's garment 10 constituting one contemplated embodiment of this invention comprises a coat 12, a liner 14 having an upper margin, and snap fasteners 20 adapted to attach the liner 14 detachably to the coat 12, at spaced intervals. Moreover, the garment 10 comprises a hood 30 having a cape 32, which is sewn to and hangs downwardly from upper portions 34 of the hood 30. In the garment 10 shown in FIGS. 1 and 2, this invention enables the hood 30 to be detachably attached at the cape 32, without needing or tearing holes in the cape 32, even if the cape 32 is double-layered or very thick.

As shown in FIG. 1, a collar 40 is sewn to the coat 12, which is made from plural layers of suitable fabric and other materials. Where the collar 40 is sewn to the coat 12, a hem 42 containing a reinforcing ribbon 44 made from suitable fabric is sewn to the coat 12 so as to hang downwardly between the coat 12 and the liner 14. The liner 14 is made from plural layers of suitable fabric and other materials, which may include thermal insulation. At the cape, the hood 30 is made from one or more layers of suitable fabric. The coat 12 comprises the hem 42.

Each fastener 20 comprises a male portion 22, which is affixed suitably to the hem 42 and to the reinforcing ribbon 44 contained by the hem 42 so as to open outwardly with respect to a firefighter wearing the garment 10, and a female portion 24, which is affixed suitably to an upper margin 32 of the liner 14 so as to project inwardly with respect thereto. The male and female portions of the fasteners 20 are snapped together so as to attach the liner detachably to the coat 12, via the hem 42, at spaced intervals.

As described in the preceding two paragraphs, the garment 10 is similar to firefighter's garments available commercially from Morning Pride Manufacturing, Inc. of Dayton, Ohio. Thus, except as illustrated in the draw and described herein, details of the garment 10 sad details of the hood 30 are outside the scope of this invention and can be readily described by persons having ordinary skill in the art.

As shown in FIGS. 1 through 5, the cape 32 is provided with four loops 50, each having two ends 52 affixed to each other and to the cape 32, at sewn seams 54 at spaced intervals. As shown in FIGS. 2 through 5, each loop 50 is adapted to extend around a respective one of the fasteners 20, between the coat 12 and the liner 14. Thus, when the liner 14 is attached detachably to the coat 12 by the fasteners 20 with each loop 50 extending around a respective one of the fasteners 20, the loops 50 attach the hood 30 detachably to the coat 12 and to the liner 14, at similar intervals.

Figure 6:
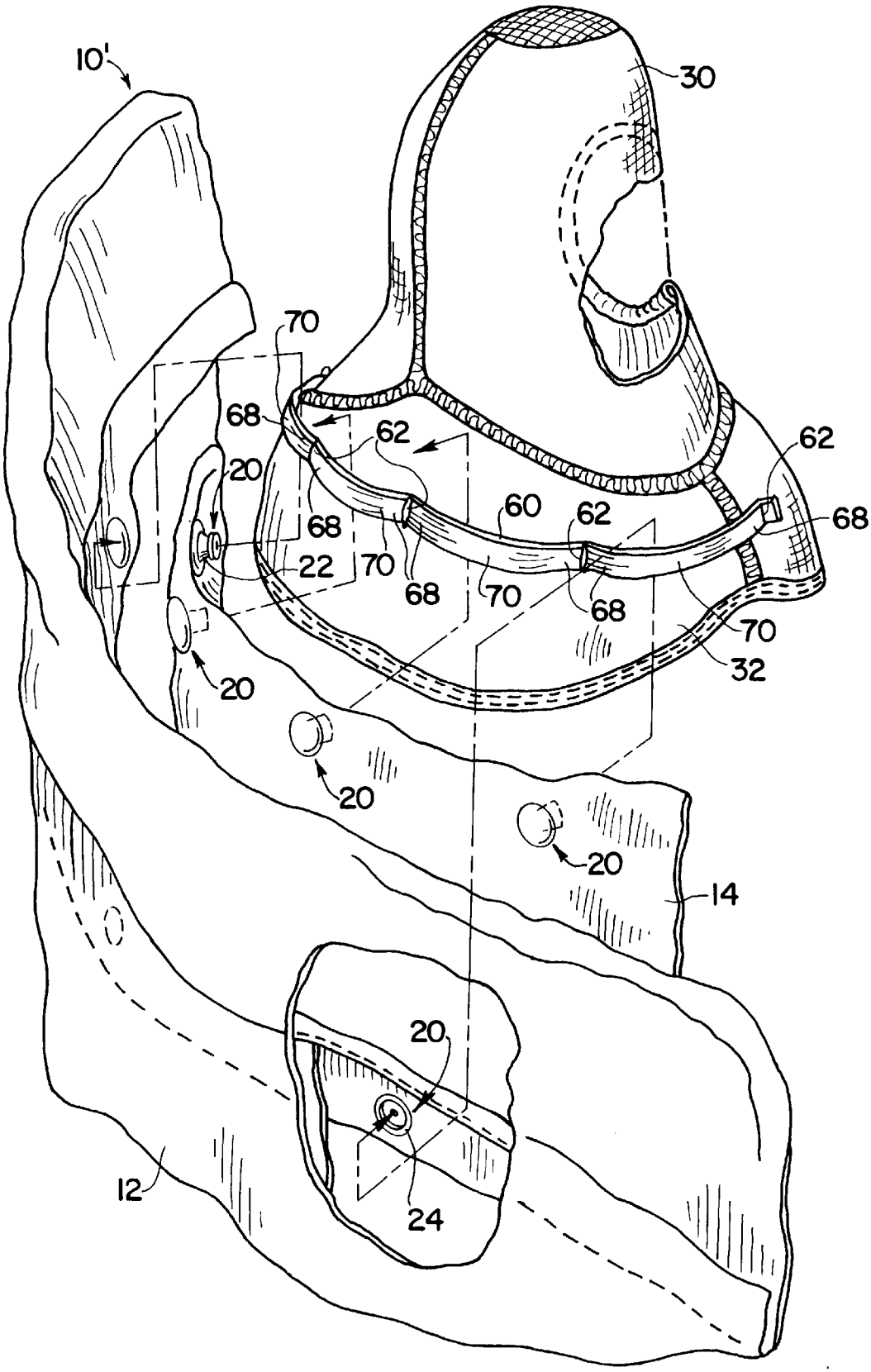
FIG. 6 is a fragmentary, partly broken away, exploded, perspective view of a firefighter's garment constituting another contemplated embodiment of this invention, as taken from one vantage.

As shown in FIGS. 6 and 7, a firefighter's garment 10' constituting another contemplated embodiment of this invention comprises is similar to the garment 10 and comprises similar components, except as illustrated in the drawings and described below. In the garment 10' shown in FIGS. 6 and 7, this invention enables the hood 30 to be detachably attached at the cape 32, without needing or tearing holes in the cape 32, even if the cape 32 is double-layered or very thick.

As shown in FIGS. 6 through 10, a continuous ribbon 60 is affixed, at sewn seams 62, to the cape 32 at spaced intervals, which define the ends 68 of four loops 70. Having sufficient slack, each loop 70 is adapted to extend around a respective one of the fasteners 20, between the coat 12 and the liner 14. Thus, when the liner 14 is attached detachably to the coat 12 by the fasteners 20, via the hem 42, with each loop 50 extending around a respective one of the fasteners 20, between the coat 12 and the liner 14, the loops 50 attach the hood 30 detachably to the coat 12 and to the liner 14, at similar intervals.

Various modifications may be made in either embodiment described above without departing from the scope and spirit of this invention.

We claim:

1. A protective garment comprising a coat, a liner, fasteners adapted to attach the liner detachably to the coat at spaced intervals, a hood having a cape hanging downwardly, and loops, each loop having two ends and being affixed at each end to the cape and each loop being adapted to extend around a respective one of the fasteners, between the coat and the liner, so as to attach the hood detachably at similar intervals when the liner is attached detachably to the coat by the fasteners.

2. The protective garment of claim 1 wherein each fastener is a snap fastener having a male portion and a female portion with one said portion affixed to the coat and with the other portion affixed to the liner.

3. The protective garment of claim 2 wherein the ends of each loop are affixed to each other and to the cape.

4. The protective garment of claim 2 wherein the ends of each loop are spaced from each other where affixed to the cape.

5. The protective garment of claim 4 wherein the loops are defined by a continuous ribbon affixed to the cape at spaced intervals defining the ends of the loops.

6. The protective garment of claim 1 wherein the ends of each loop are affixed to each other and to the cape.

7. The protective garment of claim 1 wherein the ends of each loop are spaced from each other where affixed to the cape.

8. The protective garment of claim 7 wherein the loops are defined by a continuous ribbon affixed to the cape at spaced intervals defining the ends of the loops.

9. A protective garment comprising a coat, a liner, fastener means for attaching the liner detachably to the coat at spaced intervals, a hood having a cape hanging downwardly, and loops, each loop having two ends and being affixed at each end to the cape and each loop being adapted to extend around a respective one of the fastener means, between the coat and the liner, so as to attach the hood detachably at similar intervals.

10. The protective garment of claim 9 wherein each fastener means is a snap fastener having a male portion and a female portion with one said portion affixed to the coat and with the other portion affixed to the liner.

11. The protective garment of claim 10 wherein the ends of each loop are affixed to each other and to the cape.

12. The protective garment of claim 10 wherein the ends of each loop are spaced from each other where affixed to the cape.

13. The protective garment of claim 12 wherein the loops are defined by a continuous ribbon affixed to the cape at spaced intervals defining the ends of the loops.

14. The protective garment of claim 9 wherein the ends of each loop are affixed to each other and to the cape.

15. The protective garment of claim 9 wherein the ends of each loop are spaced from each other where affixed to the cape.

16. The protective garment of claim 15 wherein the loops are defined by a continuous ribbon affixed to the cape at spaced intervals defining the ends of the loops.

* * * * *